US006553889B2

(12) United States Patent
Migliori

(10) Patent No.: US 6,553,889 B2
(45) Date of Patent: Apr. 29, 2003

(54) COMPACT PNEUMATIC CYLINDER, WITH CUSHIONING DEVICE

(76) Inventor: Luciano Migliori, Piazza Appio Claudio 8, 20124 Milan (IT)

( * ) Notice: Subject to any disclaimer, the term of this patent is extended or adjusted under 35 U.S.C. 154(b) by 0 days.

(21) Appl. No.: 09/977,385

(22) Filed: Oct. 16, 2001

(65) Prior Publication Data

US 2002/0043152 A1 Apr. 18, 2002

(30) Foreign Application Priority Data

Oct. 16, 2000 (IT) ..... MI2000A2225

(51) Int. Cl.[7] ..... F15B 15/22
(52) U.S. Cl. ..... 91/394; 92/85 B
(58) Field of Search ..... 92/85 R, 85 B, 92/164; 91/394–396, 408, 409

(56) References Cited

U.S. PATENT DOCUMENTS 2,710,595 A * 6/1955 Peterson et al. ..... 91/394 X
3,238,850 A * 3/1966 Desmarchelier ..... 91/394
3,440,930 A 4/1969 Olson
3,805,672 A * 4/1974 Pekrul ..... 91/396 X
4,343,228 A * 8/1982 Wallis ..... 91/394 X
4,862,786 A * 9/1989 Boyer et al. ..... 91/396 X
5,943,939 A * 8/1999 Orihara ..... 91/407

FOREIGN PATENT DOCUMENTS

| | | |
|---|---|---|
| DE | 4041992 | 7/1992 |
| EP | 0005407 | 11/1979 |
| EP | 0692639 A1 | 1/1996 |
| WO | WO 94/00706 | 1/1994 |

* cited by examiner

*Primary Examiner*—Edward K. Look
*Assistant Examiner*—Igor Kershteyn
(74) *Attorney, Agent, or Firm*—Young & Thompson

(57) ABSTRACT

The pneumatic cylinder includes a tubular body defining a piston chamber for a piston member, closed by front and rear heads; each head is provided with an inlet-outlet port for pressurised air, which opens out towards an annular slot coaxially arranged and communicating with the piston chamber. The piston is provided with a rod which extends through a guide bush in the front head. A pneumatic cushion is provided to control the movement of the piston at the ends of its stroke; the cushion of the front head includes a narrow passage for venting the air, and a sleeve protruding from the piston, to penetrate into an annular slot disposed coaxially around the guide bush for the piston rod.

7 Claims, 2 Drawing Sheets

COMPACT PNEUMATIC CYLINDER, WITH CUSHIONING DEVICE

BACKGROUND OF THE INVENTION

This invention refers to double-acting pneumatic cylinders, and in particular concerns improvements to pneumatic cylinders of compact or short stroke type.

STATE OF THE ART

Pneumatic cylinders of compact or short stroke type are generally used for small or medium-powered actuators; they substantially comprise a tubular body and two front and rear heads which together define a piston chamber in which a piston member reciprocates.

Both the front and the rear heads of a pneumatic cylinder are provided with inlet-outlet ports for feeding and discharging pressurized air, which open out into a central bore or cavity in the head communicating with the piston chamber; a metal sleeve is normally provided in the front head to guide a piston rod during the reciprocating movement of the piston member.

Pneumatic cylinders of compact or short-stroke type are illustrated, for example, in DE-A-40 41 992, WO-A-94/00706 and EP-A-0 692 639.

As can be seen from these documents, in particular from EP-A-0 692 639 which relates to the closest prior art, the side heads for closing the piston chamber generally consist of end plates having a limited thickness in order to maintain the lengthwise dimensions of the cylinder within values defined by specific standards; the tubular body of the cylinder or the heads are provided with inlet-outlet ports for the pressurized air, which open out directly into the piston chamber or into a cavity in the closing heads.

Due to their limited dimensions, in particular due to the reduced thickness of the side heads, until now it has been difficult, or even impossible, to provide compact cylinders with suitable pneumatic devices for cushioning and controlling the speed of the piston member at one or both ends of its power stroke, for example of the type shown in U.S. Pat. No. 3,440,930, U.S. Pat. No. 3,805,672, EP-A-0 005 407.

As can be seen from these documents, a pneumatic cushioning device, for pneumatic cylinders of conventional type, normally comprises a venting duct for venting the pressurized air remaining in the chamber of the cylinder, along the final portion of the piston stroke; the venting duct comprises a narrow passage or a throttle valve, made suitably adjustable, to control the outflow of the air and, consequently, control the speed of the piston along said final portion of its power stroke. The cushioning device also comprises a plug or closing member for closing the air inlet-outlet ports, normally consisting of a cone-shaped or cylindrical plug element which axially extends in respect to the piston rod, and is designed to penetrate into a central bore or cavity of the head, to seal against a peripheral gasket; in this way the pressurized air is allowed to flow from the piston chamber exclusively through the venting duct of the pneumatic cushioning device.

However, as can be seen in the aforementioned documents, in a conventional pneumatic cylinder the central cavity into which the inlet-outlet ports for the pressurized air open out, and the closing cone or plug member in correspondence with the front head, are axially aligned with the guide bush for the piston rod.

Consequently, the presence of the cushioning device for controlling the piston speed in pneumatic cylinders of conventional type necessarily calls for heads of considerable width, capable of containing within their thickness the aligned disposition of the central air inlet-outlet cavity and the guide bush for guiding the piston rod.

For various reasons it has never been possible to fit usual pneumatic cushioning devices on compact cylinders due to the limited dimensions and thickness of the closing heads, except by excessively increasing the overall lengthwise dimensions of the cylinder, in respect to standardized sizes.

OBJECTS OF THE INVENTION

The main object of this invention is to provide a pneumatic cylinder of compact type, provided with a pneumatic device for cushioning and controlling the speed of the piston at the end of its power stroke, of such kind as not to involve any substantial increase in length of the cylinder, maintaining its overall dimensions within standards and within dimensions normally adopted.

A further object of this invention is to provide a pneumatic cylinder of compact type provided with an extremely simple and highly efficient pneumatic cushioning device, while maintaining the overall dimensions of the cylinder comparatively smaller than those of a conventional cylinder.

For example, in a conventional ISO cylinder having a piston chamber with a diameter of 50 mm, in general the cushioning stroke require approximately 60 mm in length.

Conversely, in a compact cylinder according to the invention, also having a piston chamber of 50 mm in length, it is possible to obtain a cushioning stroke, for example ranging from 15 to 35 mm without increasing the overall dimensions, and in any case obtaining an effective braking action and control of the piston speed.

BRIEF DESCRIPTION OF THE INVENTION

In particular, the invention is directed to a cylinder of compact type, comprising:

a tubular body, defining a piston chamber;

front and rear heads for closing the piston chamber at both ends; each closing head for the piston chamber in turn comprising a pressurized air inlet-outlet port which opens out towards a central bore coaxially arranged and communicating with the piston chamber inside the tubular body;

a reciprocable piston member in said piston chamber, provided with a piston rod axially extending through a guide bush in the front head; and pneumatic cushioning means for controlling the movement of the piston member at least one end of its stroke, said cushioning means comprising a venting duct in the closing head for venting air from the piston chamber, and a plug member which axially extends along a side end of the piston member to sealingly penetrate into the central bore of said head to tightly close the piston chamber towards the air inlet-outlet port, wherein:

the air inlet-outlet port of the front head opens into an annular slot coaxially extending into the same front head and longitudinally overlapping for at least part of the guide bush for the piston rod;

in that the plug member comprises a sleeve member coaxially extending from a side end of the piston member, and along the piston rod, said sleeve member being disposed to penetrate into the annular slot to overlap the guide bush; and sealing means at the open end of the annular slot facing the piston chamber, said sealing means being provided to sealing close against the sleeve member when threaded into said annular slot.

According to a first embodiment, the annular slot is delimited by the outer cylindrical surface of the guide bush for the piston rod, and by the inner cylindrical surface of the central bore in the closing head.

According to a further embodiment, the annular slot in provided directly in the head in a position encircling the guide bush for the piston rod.

BRIEF DESCRIPTION OF THE DRAWINGS

These and further features of a pneumatic cylinder and cushioning device according to the invention, will be more clearly evident from the following description, with reference to the accompanying drawings, in which.

DETAILED DESCRIPTION OF THE INVENTION

Figure 1:
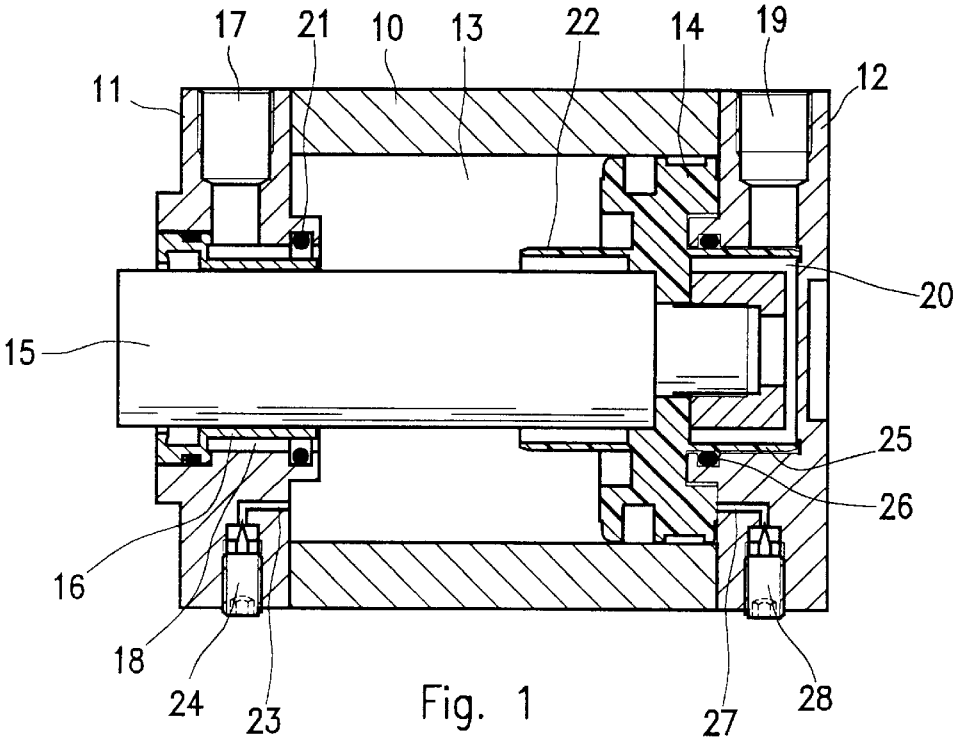
FIG. 1 shows a sectional view of a pneumatic cylinder, with the piston member in a fully retracted position, provided with a cushioning device according to a first embodiment of the invention.

With reference to the figures from 1 to 3, a description is given hereunder of a first preferred embodiment of a compact pneumatic cylinder comprising a cushioning device according to the invention.

As shown in the figures, the pneumatic cylinder comprises a tubular body 10 and two end closing heads 11 and 12 which close a cylindrical chamber 13 of the tubular body 10, through which a piston member 14 reciprocates.

The piston member 14 is fitted with a rod 15 which protrudes from the fore head 11 of the cylinder and which slides in a guide bush 16 housed in a seat provided in a central through bore in the head 11.

Each closing head 11 and 12 comprises an inlet-outlet port for pressurized air, which opens out towards an elongated cavity, disposed coaxially to the central bore of the heads 11, 12 and communicating with the piston chamber 13 of the cylinder.

More precisely, the front head 11 comprises an air inlet-outlet port 17 which opens out towards a cavity 18 in the form of an annular slot provided between the facing cylindrical surfaces of the guide bush 16 and the central bore in the head 11; the annular slot 18 extends axially and overlaps the guide bush 16 by a substantial portion of its length.

Likewise, the rear head 12 presents an air inlet-outlet port 19, which opens out towards a central bore 20, in turn communicating with the piston chamber 13 as per the front head 11.

Figure 2:
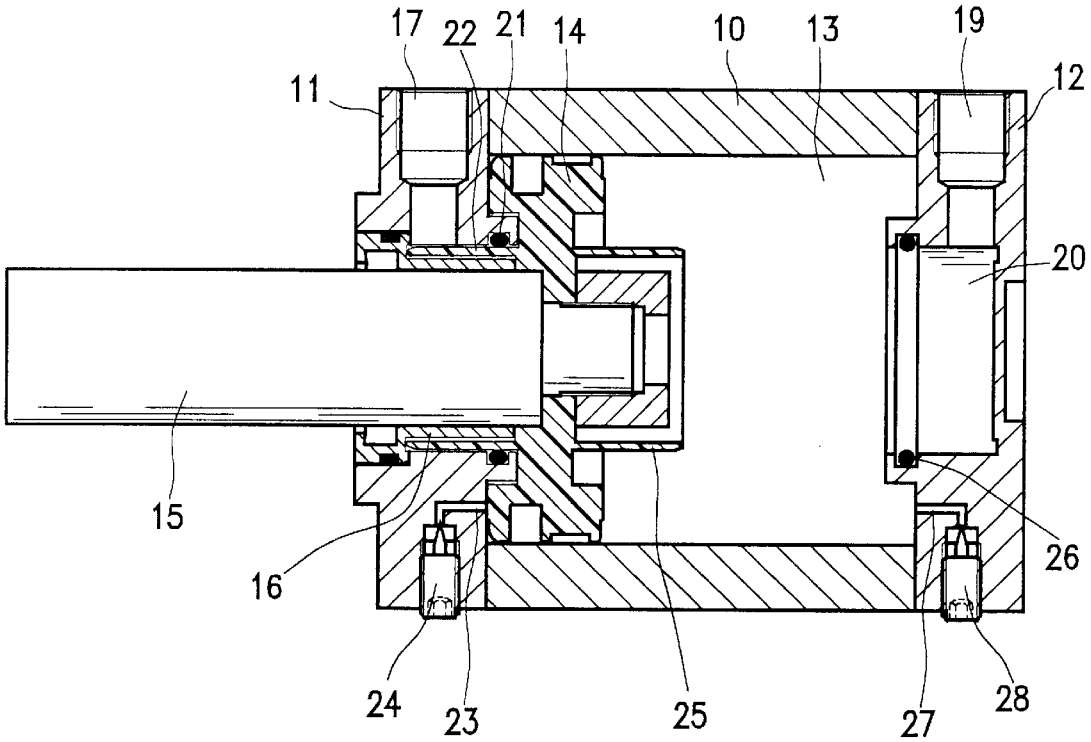
FIG. 2 shows a view similar to that of FIG. 1, with the piston in a fully forwarded position.
Figure 3:
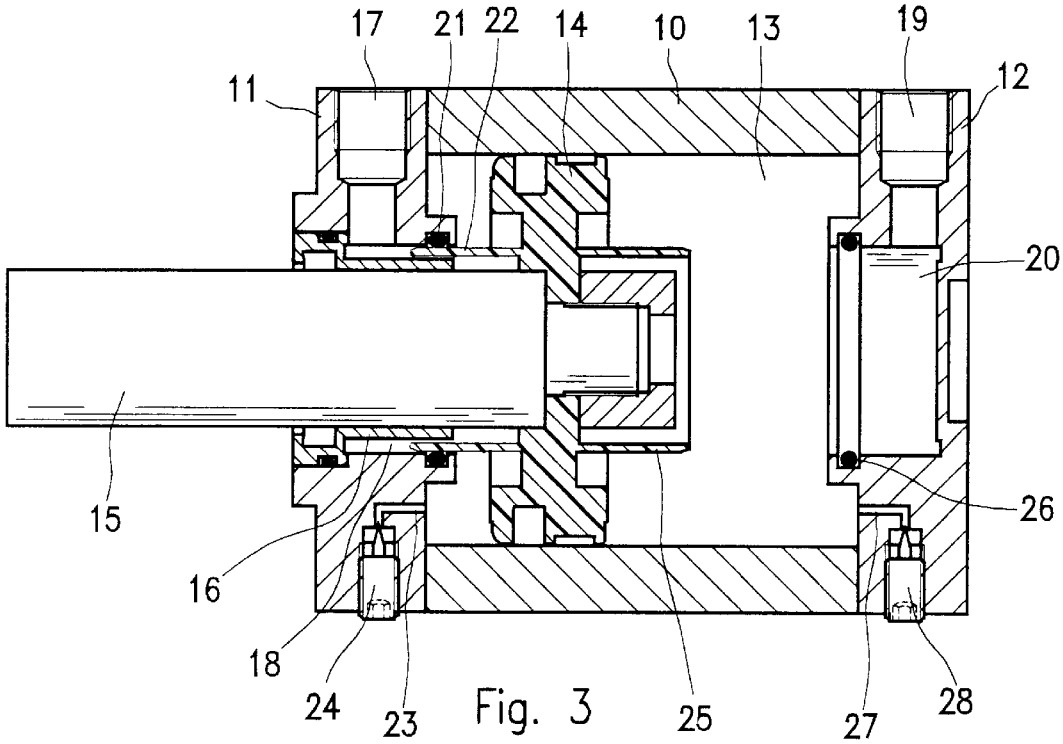
FIG. 3 shows a view similar to that of the previous figures, with the piston in an intermediate position, when the cushioning has just begun.

According to the present invention, on the side end facing the front head 11, the piston member 14 comprises a plug member 22 for sealingly closing the annular cavity 18 during reciprocation of the same piston 14; as shown in FIGS. 1 to 3, the plug member 22 is in the form of a sleeve radially spaced with respect to the rod 15, and axially aligned with the annular slot 18 to penetrate the same.

Reference 21 in the various figures also shows an annular gasket housed in a seat at the end of the central bore in the front head 11, facing the piston chamber 13 to form a seal against the sleeve 22, thereby preventing direct communication between the corresponding side of the piston chamber 13, the annular slot 18 and the port 17 during cushioning.

The front head 11 also comprises a venting duct 23 for venting the compressed air remaining in the piston chamber 13 at the end of the stroke when the piston 14 approaches the head 11, to cushion and control its speed.

The venting duct 23, in the example shown, opens out directly into the chamber 13, and comprises a restricted passage provided for example by a needle valve 24 which is suitably adjustable to more or less throttle the flow of out-coming air and consequently cushioning and varying the speed of the piston 14 during the stopping and reversal of its movement; it is however understood that the venting passage 23 and 24 can be otherwise shaped or obtained, as compared to that shown, provided it is suitable for the intended purpose.

As shown, the rear head 12 also comprises a venting duct 27 provided with a needle valve 28, as well as comprises an annular gasket 26 at the inside end of the central cavity 20, designed to co-operate with a second sleeve member 25 of the piston 14 to cushion and control the movement of the same piston 14 during its backward movement.

Figure 4:
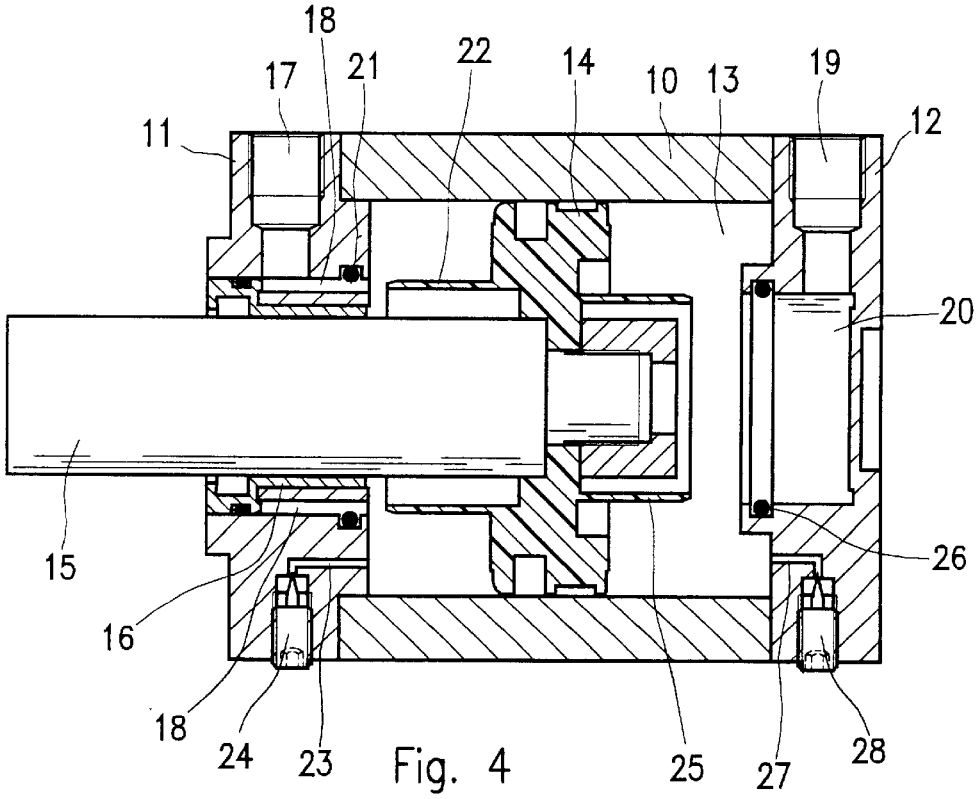
FIG. 4 shows a sectional view for a second embodiment of the invention.

FIG. 4 of the accompanying drawings shows a possible variation on the pneumatic cushioning device, relating to the front head, again comprising an annular slot 18, a plugging sleeve 22 on a piston member 14 and a venting duct 23 and 24.

The solution shown in FIG. 4 differs from that of the previous figures, in that now the annular slot 18 is directly performed into the body of the head 11, overlapping again and extending over a substantial portion of the guide sleeve 16 for the piston rod 15. For the remainder, the pneumatic cylinder of FIG. 4 is wholly similar to that of the previous figures.

From what has been described and shown it is evident therefore that a pneumatic cylinder has been provided comprising pneumatic means for cushioning and controlling the movement of the piston at the end of its stroke, which permit an effective cushioning action while maintaining the overall dimensions of the entire cylinder extremely reduced. The cushioning device also proves to be structurally simple and highly reliable, in respect to the conventional pneumatic cushioning devices.

It is understood however that what has been described and shown with reference to a compact cylinder has been given purely by way of example in order to illustrate the innovative features of the invention and that other modifications can therefore be made to the entire pneumatic cylinder, and to the cushioning device without departing from the scope of the appended claims.

What we claim is:

1. A cylinder of compact type, comprising:

a tubular body defining a piston chamber;

front and rear heads for closing the piston chamber at both ends; each closing head for the piston chamber in turn comprising a pressurized air inlet-outlet port which opens out towards a central bore coaxially arranged and communicating with the piston chamber inside the tubular body;

a reciprocable piston member in said piston chamber, provided with a piston rod axially extending through a guide bush in the front head; and pneumatic cushioning means for controlling the movement of the piston member at least one end of its stroke, said cushioning means comprising a venting duct in the closing head for venting air from the piston chamber, and a plug member which axially extends along a side end of the piston member to sealingly penetrate into the central bore of said head to tightly close the piston chamber towards the air inlet-outlet port, wherein:

the air inlet-outlet port of the front head opens into an annular slot coaxially extending into the same front head and longitudinally overlapping for at least part of the guide bush for the piston rod;

in that the plug member comprises a sleeve member coaxially extending from the front end of the piston member, and along the piston rod, said sleeve member being disposed to penetrate into the annular slot to overlap the guide bush; and sealing means at the open end of the annular slot facing the piston chamber, said sealing means being provided to sealing close against the sleeve member when threaded into said annular slot.

2. A pneumatic cylinder as claimed in claim 1, wherein said annular slot is delimited by the outer cylindrical surface of the guide bush for guiding the piston rod, and by the inner cylindrical surface of the central bore of the front head.

3. A pneumatic cylinder as claimed in claim 1, wherein said annular slot is provided directly into the front head.

4. A pneumatic cylinder as claimed in claim 1, wherein the pneumatic cushioning means further comprises a sleeve member coaxially extending from the rear end of the piston member, said sleeve member being disposed to penetrate a central bore in the closing head at the rear side of the piston chamber.

5. A pneumatic cylinder, comprising:

a body defining a piston chamber;

front and rear heads that sealingly close said piston chamber;

an inlet/outlet port in each of said front and rear heads that opens into said piston chamber;

a central bore through said front head, said central bore having a guide bush therein, said guide bush having therearound a radially outward, longitudinally extended annular slot that opens to said inlet/outlet port of said front head; a piston reciprocatingly movable in said piston chamber;

a rod extending from said piston and sealingly through said guide bush;

a vent in said front head; and a sleeve extending longitudinally from said piston around said rod toward said front head, said sleeve being spaced radially outwardly from said rod by a gap, said gap being aligned to receive said guide bush and said sleeve being aligned to penetrate said annular slot to sealingly close said inlet/outlet port of said front head during reciprocating movement of said piston.

6. The cylinder of claim 5, wherein said rear head comprises a central recess and further comprising a second sleeve that extends longitudinally from said piston around said rod toward said rear head, said second sleeve being aligned to penetrate said central recess to sealingly close said inlet/outlet port of said rear head during reciprocating movement of said piston.

7. The cylinder of claim 5, wherein said annular slot is in said front head.

* * * * *